US006419767B2

(12) United States Patent
Iihara et al.

(10) Patent No.: US 6,419,767 B2
(45) Date of Patent: Jul. 16, 2002

(54) DISTORTION CONTROL METHOD AND COOLING POWER MEASURING DEVICE

(75) Inventors: Michio Iihara; Masami Yamaguchi; Jun Yoshitomi; Takeshi Maruyama, all of Iwata (JP)

(73) Assignee: NTN Corporation, Osaka (JP)

( * ) Notice: Subject to any disclaimer, the term of this patent is extended or adjusted under 35 U.S.C. 154(b) by 0 days.

(21) Appl. No.: 09/778,779

(22) Filed: Feb. 8, 2001

(30) Foreign Application Priority Data

Feb. 17, 2000 (JP) ..... 2000-039301

(51) Int. Cl.[7] ..... C21D 1/60
(52) U.S. Cl. ..... 148/511; 702/99
(58) Field of Search ..... 148/660, 664, 148/508, 5–11; 702/99

(56) References Cited

U.S. PATENT DOCUMENTS 5,681,407 A * 10/1997 Yu et al. ..... 148/633

FOREIGN PATENT DOCUMENTS

JP 4-59921 2/1992

OTHER PUBLICATIONS

"Liquid Concentration Management System for Water–Soluble Quenching Coolent", Yoshitaka Misaka and Kazuhiro Kawasaki, Resume for The 44th Spring Meeting of Japan Society for Heat Treatment, (May 27 and 28, 1997), pp. 71 and 72 (with partial translation).

* cited by examiner

*Primary Examiner*—Sikyin Ip
(74) *Attorney, Agent, or Firm*—McDermott, Will & Emery

(57) ABSTRACT

A distortion control method that can suppress distortion of a member during quenching and a cooling power measuring device that can precisely measure cooling power are provided. In the distortion control method, when the member is subjected to quenching using liquid cooling medium, the cooling power of the cooling medium being used is maintained within a prescribed range, so that variation in distortion suffered by the member is restricted.

9 Claims, 6 Drawing Sheets

DISTORTION CONTROL METHOD AND COOLING POWER MEASURING DEVICE

BACKGROUND OF THE INVENTION

1. Field of the Invention

The present invention relates to a method of controlling distortion due to heat treatment during quenching of automotive parts or the like, and a device for measuring cooling power of liquid cooling medium for use in a quenching device.

2. Description of the Background Art

It is often the case that, once quenching of automotive parts is completed, the parts are put to use without being subjected to further processing. Thus, distortion due to the quenching should be limited in a small range. In particular, with wheel driving parts, such distortion will lead to noise at the time of engagement of toothed gears, or degradation in durability, and therefore, restriction of such distortion is a critical issue. A number of examinations and analyses have been made in an effort to restrict the distortion. However, such distortion due to heat treatment results from a variety of factors that affect to one another in a complicated manner. Further, the testing itself incorporates variation therein. Thus, detailed analyses have not been made successfully; a general tendency for each factor would be found at best.

In an effort to stabilize distortion, e.g., in over pin diameter (OPD) of an outer ring of constant velocity universal joint (CVJ), the inventors have focused on management of the following factors causing such distortion: (1) an output of high-frequency coil for heating; (2) concentration of coolant within liquid cooling medium; and (3) temperature of the cooling medium, and have succeeded in producing good results.

Due to increasingly stringent demands for suppressing distortion of automotive parts, however, it has become no longer possible to fulfill such demands with the conventional techniques. Thus, to quantitatively extract the effects leading to the distortion as described above, the inventors conducted a measurement of cooling power of liquid cooling medium in a quenching line in a strict manner allowing no variation to be incorporated therein, and examined a relation between the cooling power and the distortion. As a result, the inventors have succeeded in clarifying the effects of the cooling power of the cooling medium on the distortion due to heat treatment, which had been uncertain before conduction of such strict measurement.

SUMMARY OF THE INVENTION

An object of the present invention is to provide a distortion control method that allows suppression of distortion due to heat treatment during quenching of a member, and a cooling power measuring device that enables strict measurement of cooling power of cooling medium that plays an important role in such distortion control.

According to a distortion control method of the present invention, when a member is being subjected to quenching using liquid cooling medium, cooling power of the cooling medium being used is maintained within a prescribed range so as to suppress variation in distortion suffered by the member.

In the course of examination of a relation between distortion due to the quenching and cooling power of the cooling medium, the inventors made a measurement of the cooling power with high precision excluding variation inherent to such cooling power measurement, and as a result, they succeeded in clarifying a significant influence of the cooling power on the distortion. The cooling power is measured as a cooling time that is required for cooling a sample member of a prescribed form by a prescribed temperature range. The correlation between this cooling time and the distortion is not clearly recognized if (a) the material of the sample member transforms in the prescribed temperature range; (b) an immersion depth of the sample member in the cooling medium varies in a range of ±1 mm; and (c) a thick oxide film is formed on the surface of the sample member when heating the sample member. However, by measuring the cooling power using, as a material of the sample member, Ni-based alloy such as Inconel that (a') maintains an austenite phase from room temperature to high temperature and (b') is excellent in oxidation resistance, thereby forming almost no oxide film, and (c') by positioning the sample member in the cooling medium with accuracy within a range of ±0.03 mm, it has become possible to confirm that the cooling power of the cooling medium in the quenching device significantly affects the distortion. This phenomenon was made clear for the first time as the result of the high-precision measurement of the cooling power. Conventionally, the effect of the cooling power on the distortion was not recognized exactly, but was known vaguely as a kind of tendency. As a result of clarification of such phenomenon as described above, it has become clear that the distortion due to heat treatment can be controlled by maintaining the cooling power of the cooling medium in a fixed range. The quenching as mentioned above may be induction hardening, or the entire member may be heated in a heating furnace. Throughout the specification, the cooling power is expressed using a convenient measure. More specifically, a cooling time in which a sample member is cooled by a prescribed temperature range, or a concentration of coolant included in liquid cooling medium that is expressed as an equivalent new coolant concentration, as will be described later, is used as the measure to express the cooling power.

In the distortion control method of the preset invention, the cooling medium is cooling water including coolant, and a change of cooling power of the cooling water due to a running change of the coolant is maintained in the fixed range.

The coolant is a water-soluble liquid polymer, such as polyalkylene glycol (PAG). Normally, the coolant is dissolved into cooling water in concentration of 5–20% for prevention of quenching crack. Using the coolant, a uniform vapor film is formed on the surface of the member undergoing the heat treatment, which helps slow down the cooling, thereby preventing the quenching crack. Thus, by dissolving the coolant in the cooling medium and maintaining the cooling power in a fixed range, it becomes possible to suppress the distortion while preventing the quenching crack. Since the coolant consists of liquid polymer as described above, the polymerization degree of such high polymer is lowered as heat history is accumulated during the quenching. Therefore, as operating days pass from the first day of use of new liquid of coolant, the cooling power of the cooling medium increases in a constant manner. If the cooling power is expressed using the equivalent new coolant concentration as will be described below, the value decreases in a constant manner. During this, however, the concentration of coolant measured by a saccharimeter does not exhibit a significant change. This means that the cooling power cannot be estimated by only measuring the concentration using the saccharimeter. The cooling power ceases to increase after 30 days have passed since the day on which cooling medium in the quenching device was renewed and the use of new liquid of coolant was started. It is said that, when the polymerization degree of polymer is lowered to a certain extent, the polymer is stabilized against thermal shock. The stabilization of the cooling power after a lapse of 30 days as described above is considered because the polymer has reached such low polymerization degree. The distortion would not be controlled accurately if only the cooling power of newly applied cooling medium is considered without paying attention to such change in cooling medium over time.

The distortion control method of the present invention is a method of measuring cooling power of cooling medium employing quenching of a sample member in a prescribed form made of a material that does not transform in a temperature range to be measured. The measurement is conducted by immersing the sample member into the cooling medium and positioning the member at its quenching stop position with accuracy within a range of ±0.03 mm.

By performing such high-precision cooling power measurement with positioning accuracy within a range of ±0.03 mm as described above, it has become clear for the first time that the cooling power has a significant influence on the distortion. Thus, by utilizing such high-precision cooling power measurement, the distortion can be controlled effectively. For more effective control of the distortion, positioning accuracy within a range of ±0.015 mm will be desirable. As described above, the cooling power may be expressed as a cooling time that is required for cooling a sample member of a prescribed shape by a prescribed temperature range. In this case, the cooling power is higher as the cooling time is shorter. Alternatively, the cooling power may be expressed as an equivalent new coolant concentration. More specifically, a cooling time that is actually required for cooling a sample member using cooling medium as a target of measurement is correlated with a cooling time that would be required when the same sample member is cooled using cooling medium including only new coolant. It is then calculated what % of new coolant should be included in the cooling medium to achieve the same cooling time as with the target cooling medium. This percentage is called the "equivalent new coolant concentration". For example, it can be said like: cooling medium initially containing 15% of new coolant has been used for 20 days, and now the equivalent new coolant concentration of this cooling medium is decreased to 12%. In this case, the cooling power is improved as the equivalent new coolant concentration decreases.

The change in cooling power of the cooling medium is significant for a prescribed time period from the start of use of the new liquid of coolant, and it then becomes smaller and comes to stabilize. The distortion control method of the present invention utilizes cooling water that has entered such stabilized stage.

For example, when the cooling power of cooling medium including coolant is represented by the equivalent new coolant concentration, the concentration decreases for about 30 days from the start of use of the new coolant in an unvaried manner, if cooling medium is not resupplied or partly removed. After the lapse of 30 days, however, the change in the equivalent new coolant concentration becomes small. Thus, by using the cooling water as described above, the running change of the cooling power becomes negligible as cooling power of an approximately constant level is maintained, and therefore, it becomes possible to readily control the distortion due to heat treatment.

In the distortion control method of the present invention, new liquid of coolant is resupplied to keep the cooling power of the cooling water in a fixed range.

As the cooling power of new liquid of coolant is known, it is possible to adjust the cooling power of the cooling water by increasing/decreasing the ratio occupied by the new liquid of coolant within the cooling water.

In the distortion control method of the present invention, the distortion of the member during the quenching is controlled using a cooling power transition table that indicates a running change in cooling power of cooling medium from the start of use of the new liquid of coolant.

As the control is done based on this cooling power transition table, it is unnecessary to measure the cooling power day by day. It is possible to determine the cooling power of the quenching device at any time simply by calculating how many operating days have passed since the start of use of the new liquid of coolant. As a result, convenient and accurate control of distortion is enabled. The measurement of cooling power is desirably conducted using the high-precision measuring method as described above. The cooling power transition table may be represented as a graph or table, or even as enumeration of data. The same applies to any table that will be described below.

In the distortion control method of the present invention, the distortion of the member during the quenching is controlled using a cooling power transition table in which transition in cooling power of cooling medium from the start of use of new liquid of coolant as well as transition in concentration of coolant measured using a saccharimeter are indicated as a function of time.

Because of the presence of such table, when the same quenching is being repeated, it is possible to check the cooling power simply by measuring the concentration of the coolant by the saccharimeter and by calculating how long the coolant has been used. Accordingly, it becomes possible to confirm the cooling power in a simple and convenient manner.

In the distortion control method of the present invention, the cooling power of cooling medium is adjusted using a distortion table in which a relation between distortion of a member during quenching and cooling power of cooling medium is indicated.

With the presence of such table that makes a specific value of the distortion realized, it becomes possible to control as described above. The distortion is normally expressed in % as a ratio of a dimension of a member as a target of measurement after quenching relative to its dimension before the quenching. However, it may be expressed as an absolute value of such difference in dimension.

In the distortion control method of the present invention, the cooling power of the cooling medium is evaluated based on a time required, upon quenching of a member, to lower a temperature of the member from a temperature $T_1$ to a temperature $T_2$ that is lower than $T_1$.

To derive the cooling power according to an academic definition, complicated calculations will be required on its way. Thus, in the present invention, the cooling power is conveniently represented by a time required for cooling as described above. According to the present invention, sample members of an identical shape formed of an identical material are cooled using approximately the same cooling medium by the same temperature range. Thus, the cooling time can be utilized as a highly accurate and convenient measure of the cooling power. The cooling power according to the academic definition requires a material constant of the sample member, for example, such that it can be applied even if the cooling medium or cooling temperature range, or the material of the sample member changes. Although such cooling power according to the academic definition is derived using complicated calculations, its accuracy is rather low.

In the distortion control method of the present invention, the cooling power of the cooling medium is evaluated, assuming that the quenchings of the same sample are conducted using cooling medium including only new coolant, by obtaining a concentration of the new coolant that should be included in the cooling medium to obtain the same cooling time as with the target cooling medium.

The cooling power can also be expressed accurately and conveniently by employing such equivalent new coolant concentration derived from the cooling time as described above.

The cooling power measuring device of the present invention is a device for measuring cooling power of cooling medium in a quenching device. This measuring device includes: a heating device for heating a sample member; a cooling medium bath for storing the cooling medium for use in cooling the heated sample member; a transfer device for transferring the sample member from the heating device to the cooling medium bath and for immersing the sample member into the cooling medium and holding the member at a prescribed position; and a transfer control device for control of an operation of the transfer device. The transfer device and the transfer control device are configured to suppress variation in a quenching stop position at which the sample member immersed in the cooling medium is to be held, within a range of ±0.03 mm.

A cooling time that is required for cooling a sample member by a prescribed temperature range is greatly affected by its stop position. Therefore, the stop position should be controlled with positioning accuracy within the range of ±0.03 mm; otherwise, the distortion control as described above cannot be conducted accurately. To achieve more accurate control of the distortion, positioning accuracy within the range of ±0.015 mm is desirable. As the cooling medium bath, a temperature-controlled bath is preferred. As the heating device, a high-frequency coil is preferable which enables rapid heating so that generation of oxide film is restricted. For positioning the sample member in a shorter period of time, it is preferred that the member is partially immersed into the cooling medium and held at a prescribed position. Instead, however, the entire sample member may be immersed therein.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
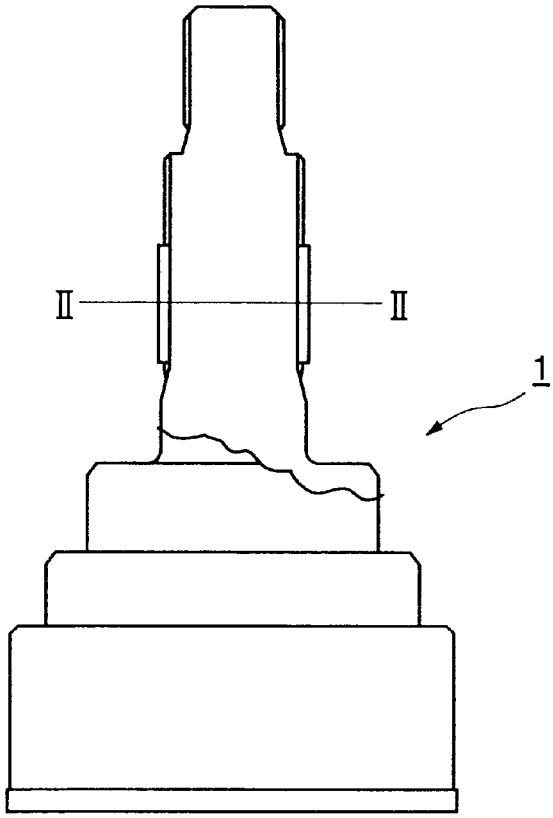
FIG. 1 is a partly diagrammatic sectional view of an outer ling of constant velocity universal joint being a member that is subjected to quenching according to an embodiment of the present invention.
Figure 2:
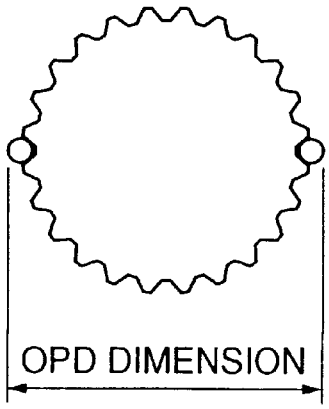
FIG. 2 is a cross sectional view taken along a line II—II of FIG. 1.

Embodiment of the present invention will now be described with reference to the drawings. Referring to FIG. 2 showing the cross section taken along the line II—II of FIG. 1, a dimension of over pin diameter (OPD) is critical in terms of distortion. The outer ring of constant velocity universal joint as shown is subjected to induction hardening to cure its surface for the purposes of improving its wear resistance and fatigue characteristics. This quenching is performed at a temperature exceeding 800° C. at which carbon steel constituting the outer ring of the constant velocity universal joint is austenitized. Thus, by the quenching, the carbon steel is transformed to a hardened structure with the above-described characteristics being improved. Here, cooling power of cooling medium for use in the quenching is important. A method of measuring the cooling power of the cooling medium will now be described.

Figure 3:
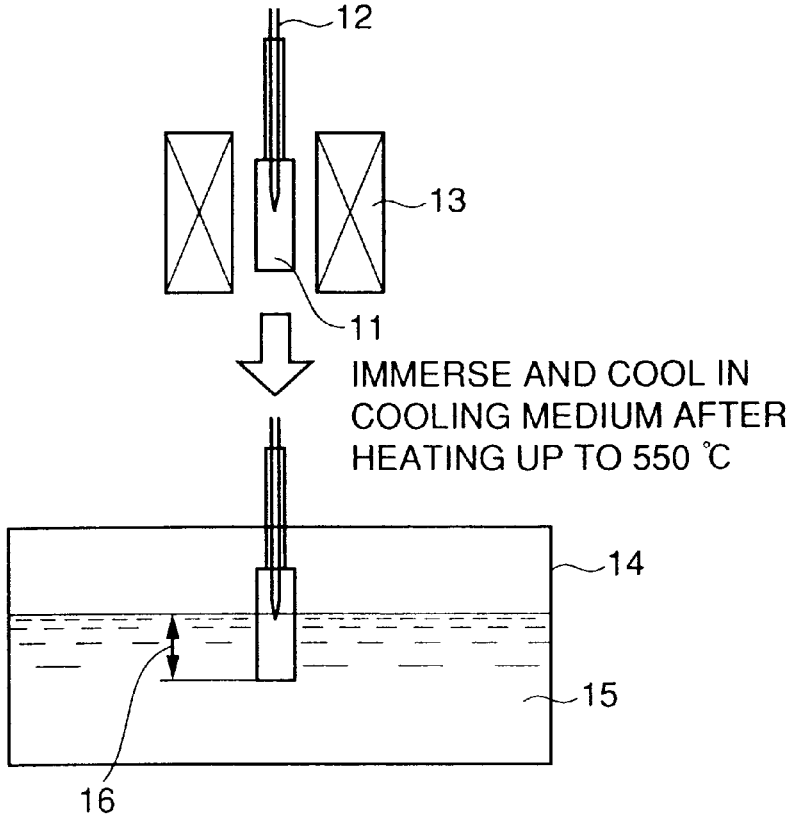
FIG. 3 shows a configuration of a cooling power measuring device that is used for measuring cooling power of cooling water in a quenching device according to the embodiment of the present invention.
Figure 4:
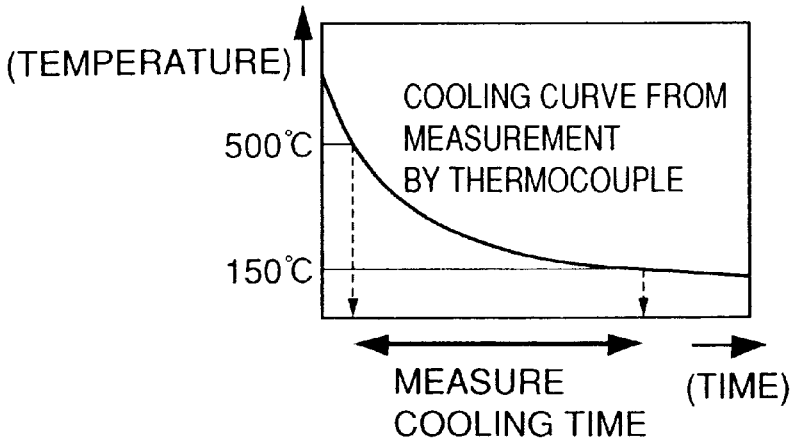
FIG. 4 shows a cooling curve that is obtained when cooling a sample member in the cooling power measuring device shown in FIG. 3.
Figure 5:
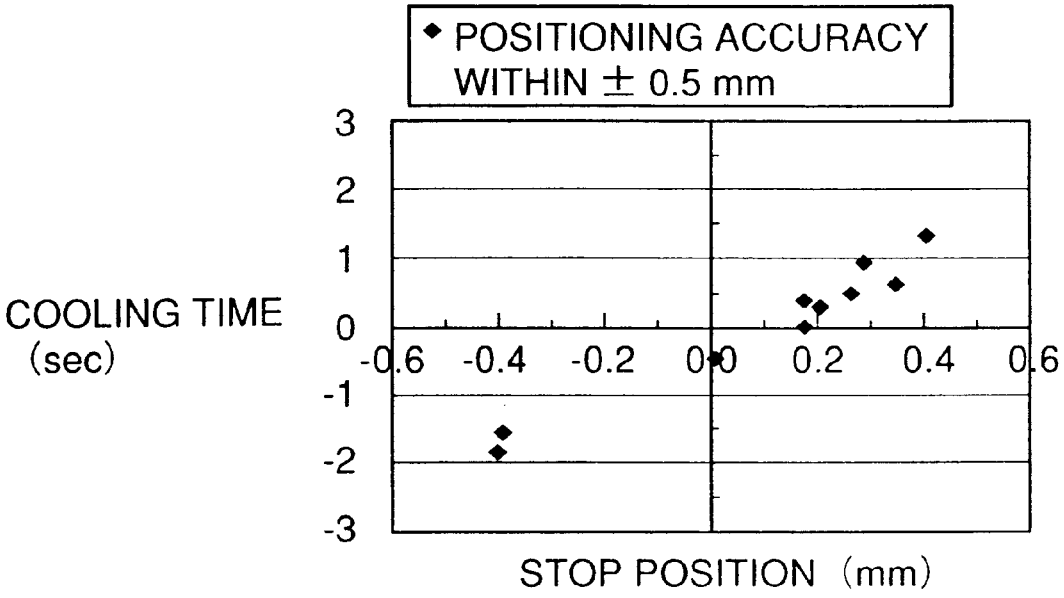
FIG. 5 shows variation in cooling power in a measurement of the cooling power, wherein positioning accuracy of the sample member at a quenching stop position is within ±0.5 mm.
Figure 6:
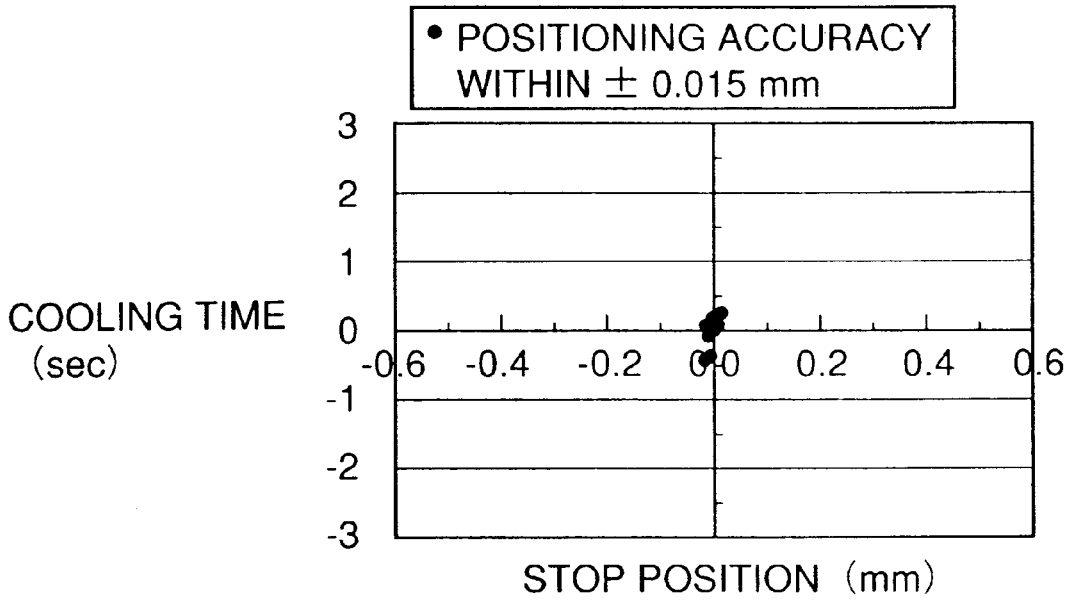
FIG. 6 shows variation in cooling power in a measurement of the cooling power according to the present invention, wherein the positioning accuracy of the sample member at the quenching stop position is within ±0.015 mm.

Referring to FIG. 3, the cooling medium 15 is extracted from the cooling water actually used in a cooling medium bath in a quenching line in a factory. To accurately comprehend the change in the cooling water over time, it is necessary to extract the cooling water day by day in the course of measurement. Sample member 11 is preferably fabricated using Incoloy, which is Ni-based alloy that maintains an austenite phase and does not transform from room temperature to high temperature. Incoloy also exhibits good heat resistance and forms almost no oxide film. Therefore, it will not cause considerable variation even if it is repeatedly used for the quenching. Sample member 11 is formed in a cylindrical shape having a diameter of 10 mm and a thermocouple 12 is embedded in its center. For measurement of the cooling power, sample member 11 is heated by a high frequency coil 13 to 550° C. as measured by thermocouple 12, and held at the temperature for a prescribed time period. Thereafter, sample member 11 is immersed into cooling water 15 including coolant as a target of measurement, which is held at 100° C. in a temperature-controlled bath 14, to a prescribed depth 16 for cooling. According to the present embodiment, positioning accuracy for positioning sample member 11 at a prescribed position is within ±0.015 mm. The electrical signal sent from thermocouple 12 undergoes data processing, and is displayed as a cooling curve on a chart having a time axis as its horizontal axis, as shown in FIG. 4. From this cooling curve, the time required for cooling the member from 500° C. to 150° C. is derived, which is used as a measure of the cooling power. Conventionally, the accuracy for positioning the sample member at its stop position was low, i.e., on the order of ±0.5 mm. With such poor accuracy, the variation in the cooling time was as much as 3.2 seconds, as shown in FIG. 5. In the present invention, however, the accuracy for positioning sample member 11 at its stop position as described above was improved. Specifically, by achieving the positioning accuracy within ±0.015 mm, the variation in the cooling time was limited within 0.8 seconds, as shown in FIG. 6. Throughout the measurement of the cooling power as described above, cooling medium containing only new coolant was always used. It is noted that, even if the positioning accuracy as described above is set within ±0.03 mm, cooling power utilizable for the control of the distortion could be obtained.

Figure 7:
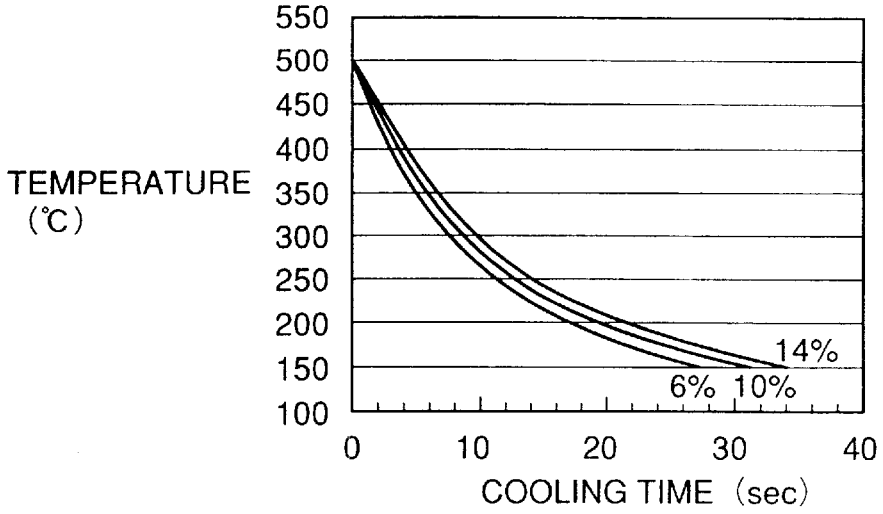
FIG. 7 shows cooling curves for the sample members in the measurement of the cooling power according to the present invention.
Figure 8:
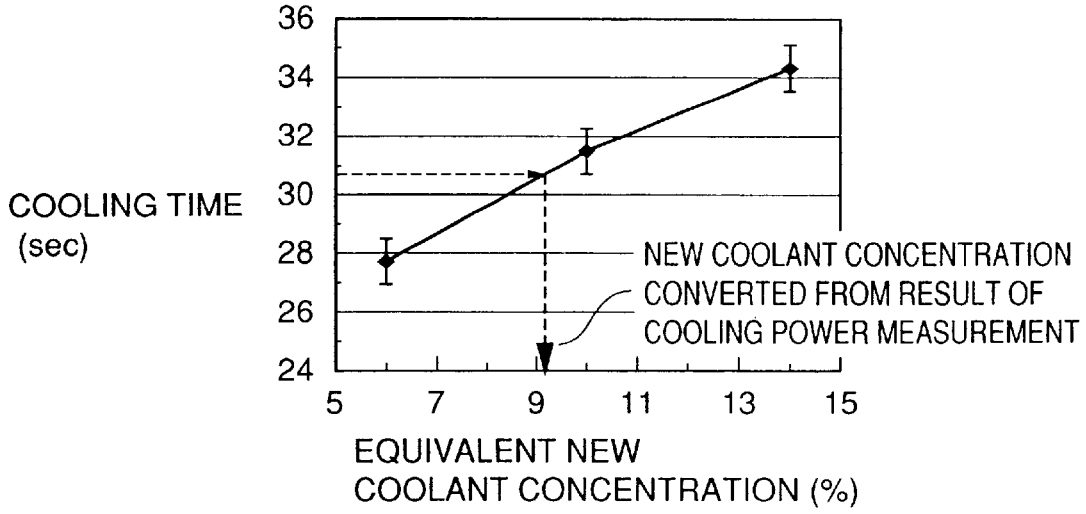
FIG. 8 illustrates how to obtain an equivalent new coolant concentration from a cooling time of the sample member according to the present invention.

FIG. 7 shows cooling curves each obtained when cooling is conducted utilizing cooling medium including the stated percentage of new coolant, with positioning accuracy of the sample member within ±0.015 mm. From FIG. 7, it is noticed that, as the content of the new coolant increases, the cooling becomes slower and the cooling power decreases. The straight line shown in FIG. 8 represents a relation between the cooling time and the coolant concentration when a sample member is immersed and cooled in cooling medium including only new coolant (equivalent new coolant concentration). From this straight line, it becomes possible to obtain an equivalent new coolant concentration from the cooling time actually obtained from the cooling medium used in a quenching line of a factory. For example, referring to FIG. 8, when the cooling time obtained from the cooling medium as a target of measurement is 30.7 seconds, the equivalent new coolant concentration of this cooling medium can be determined as 9.2%. Before improvement of the positioning accuracy, with that of at least ±0.5 mm, the cooling time would vary on the order of ±2 seconds, leading to variation in equivalent new coolant concentration on the order of ±2%. With such a large variation, the change of cooling power over time could not be detected, and therefore, it would be unimaginable to control the distortion by the cooling power. The above-described method of expressing the cooling power as the equivalent new coolant concentration derived from the cooling time is referred to as a cooling faculty (CF) method. Conventionally, as simple means for measuring the concentration of coolant within the cooing medium, a saccharimeter has been used. Hereinafter, for the purposes of comparison, the concentration measured by the saccharimeter according to the prior art will also be described.

Figure 9:
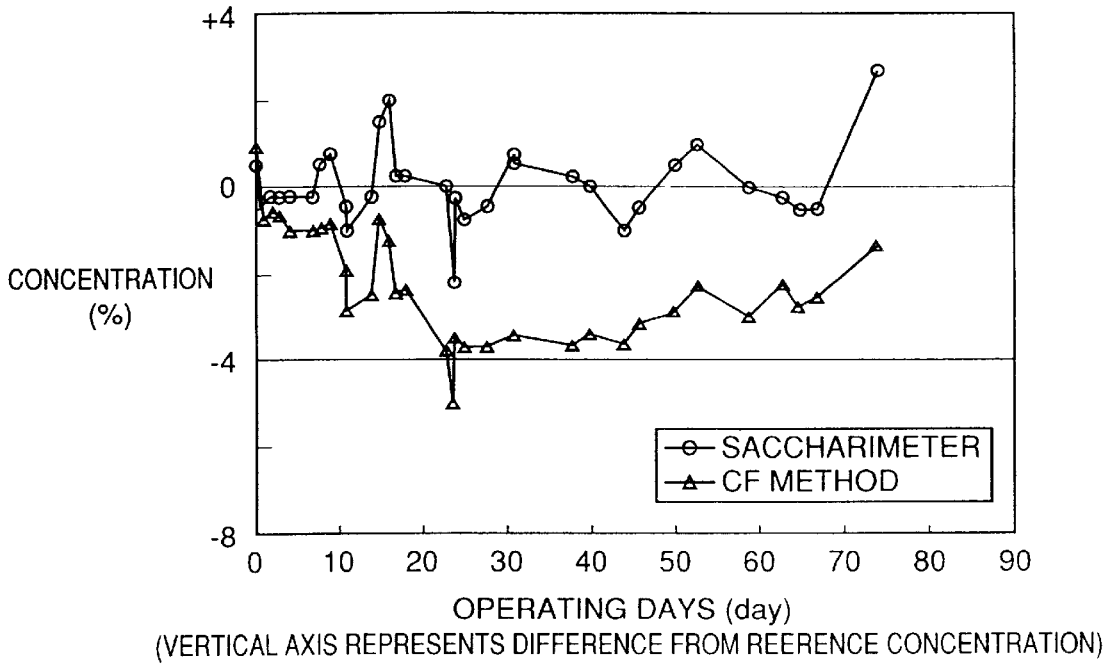
FIG. 9 shows changes over time of the equivalent new coolant concentration (cooling power) of the present invention and a concentration of coolant measured by a saccharimeter.
Figure 10:
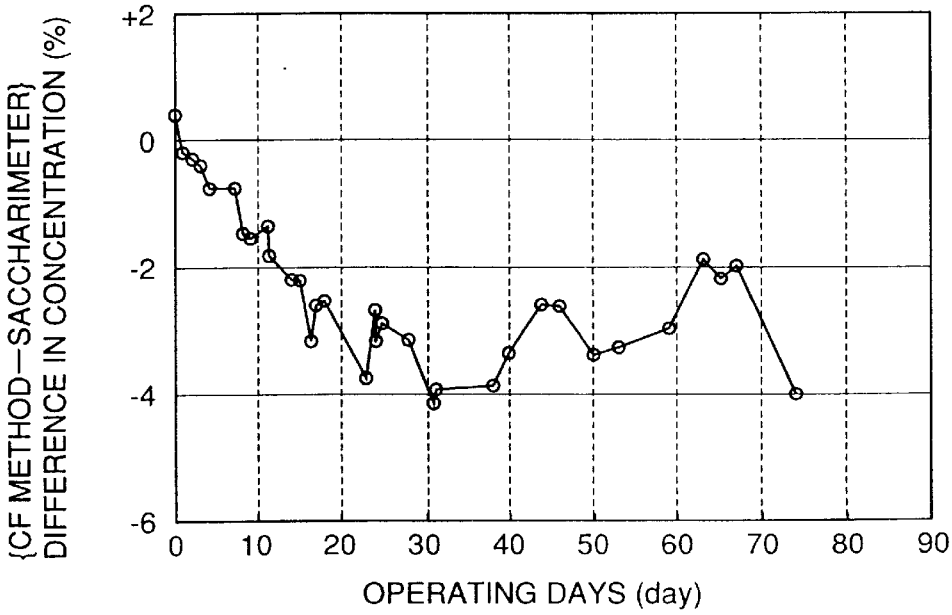
FIG. 10 shows a change over time of a difference between the equivalent new coolant concentration (cooling power) of the present invention and the concentration of coolant measured by the saccharimeter.

Transition in cooling power of cooling medium over time is shown in FIG. 9, wherein a horizontal axis represents operating days that have passed from the day on which the entire cooling medium was renewed and the use of new liquid of coolant started. Obtained by the CF method is the cooling power, measured using the method as shown in FIG. 3 with improved positioning accuracy, and expressed as the equivalent new coolant concentration as described above. According to FIG. 9, the equivalent new coolant concentration starts to decrease from the first day of the use of new liquid of coolant. Such decrease ceases after 25 days have passed from the start day, and thereafter, the concentration is held approximately at a fixed level. In FIG. 9, the concentration measured by the saccharimeter is also shown. This shows a change similar to that of the equivalent new coolant concentration, although any specific pattern cannot be observed from the change. FIG. 10 shows a change over time of the difference between the equivalent new coolant concentration and the concentration measured by the saccharimeter. It decreases in an unvaried manner for almost 30 days, and thereafter, there comes a time period in which almost no change is observed. Utilizing the graph of FIG. 10, it becomes possible, by simply measuring the concentration using the saccharimeter, to obtain the equivalent new coolant concentration from the concentration measured and the number of days passed from the start day.

Figure 11:
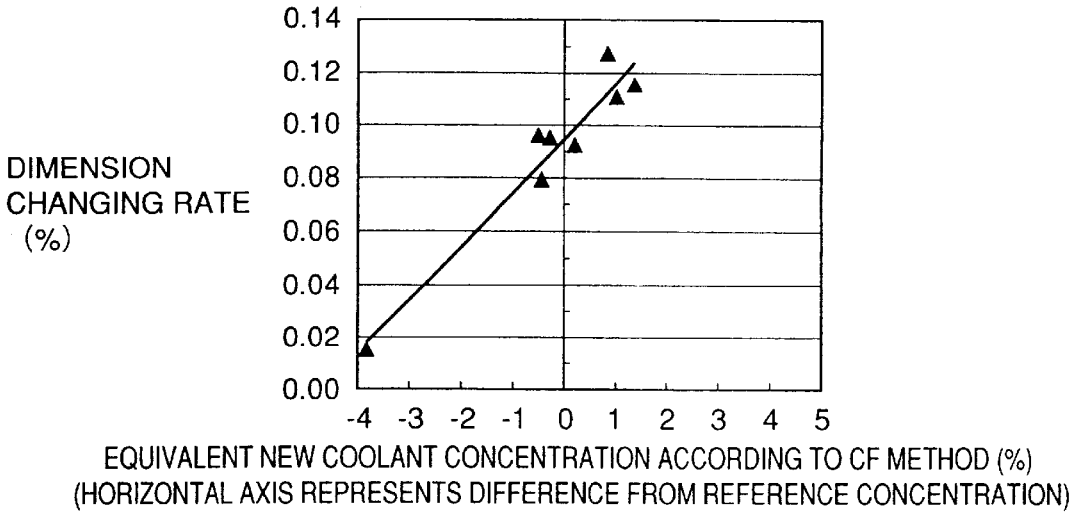
FIG. 11 shows a relation between an outer diameter changing rate of a member subjected to quenching and the equivalent new coolant concentration.
Figure 12:
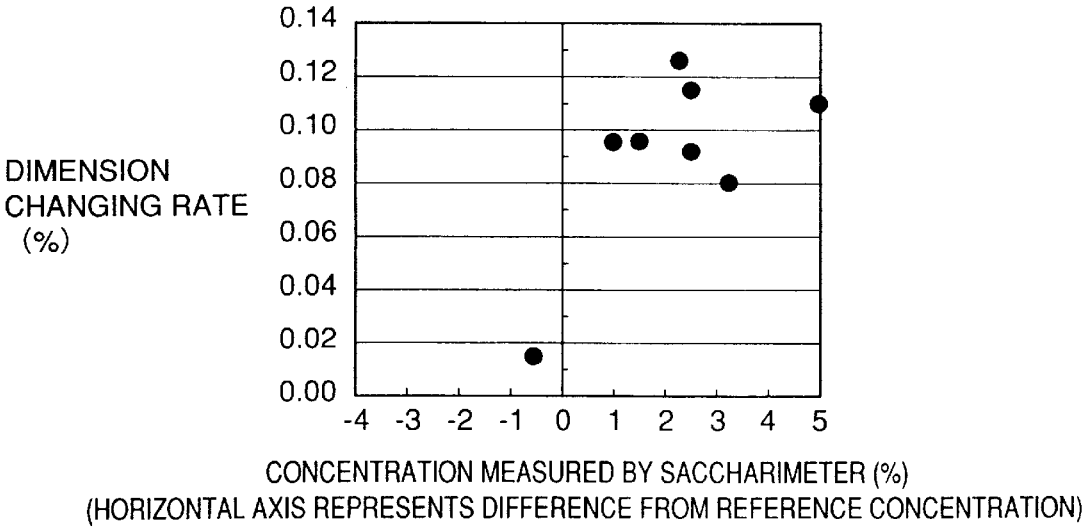
FIG. 12 shows a relation between the outer diameter changing rate of the member subjected to quenching and the concentration of coolant measured by the saccharimeter.

As seen from FIG. 11, it is clear that there is a strong correlation between the distortion and the equivalent new coolant concentration. On the contrary, it cannot be said that there is a certain correlation between the distortion and the concentration measured by the saccharimeter, as shown in FIG. 12.

As explained above, the present invention was inspired by the distinct correlation between cooling power and distortion that is observable only when cooling power is measured by positioning a member to be cooled in cooling medium with high positioning accuracy within a range of ±0.03 mm, or even within ±0.015 mm. According to the present invention, it is possible to keep track of cooling power precisely even when the cooling medium changes over time. Thus, distortion due to heat treatment can be controlled to a minimum.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method for controlling distortion of a member subjected to quenching in a liquid cooling medium method, comprising the steps of measuring a cooling power of said liquid cooling medium by quenching a sample member having a prescribed shape formed of a material that does not transform in a measured temperature range, the measurement conducted by steps including immersing said sample member in said cooling medium and stopping said sample member at a quenching stop position with positioning accuracy within a range of ±0.03 mm;

quenching a member using the cooling medium; and maintaining the cooling power of said cooling medium within a prescribed range to suppress variation in distortion suffered by the member.

2. The distortion control method according to claim 1, wherein said cooling medium includes cooling water and coolant, and a change in the cooling power of the cooling medium due to a running change of said coolant is held in a fixed range.

3. The distortion control method according to claim 1 wherein, the cooling power of said cooling medium changes for a prescribed time period from a start of use of said cooling medium and then becomes smaller until reaching a stabilized range, and said measurement is conducted using the cooling medium that has entered the stabilized range.

4. The distortion control method according to claim 1, wherein the cooling power of said cooling water is maintained in the prescribed range by resupplying new liquid of said coolant.

5. The distortion control method according to claim 1, wherein the distortion of said member during the quenching is controlled using a cooling power transition table indicating a running change of the cooling power of said cooling medium from a start of use of new liquid of said coolant.

6. The distortion control method according to claim 1, wherein the distortion of said member during the quenching is controlled using a cooling power transition table indicating running changes of the cooling power of said cooling medium and of a concentration of coolant measured by a saccharimeter from a start of use of new liquid of said coolant.

7. The distortion control method according to claim 1, wherein the cooling power of said cooling medium is adjusted using a distortion table indicating a relation between distortion of said member during said quenching and the cooling power of said cooling medium.

8. The distortion control method according to claim 1, wherein the cooling power of said cooling medium is evaluated by a time required, when quenching the member, to lower a temperature of the member from a temperature $T_1$ to a temperature $T_2$ that is lower than temperature $T_1$.

9. The distortion control method according to claim 8, wherein the cooling power of said cooling medium is evaluated, assuming that the quenchings of the same sample are conducted using cooling medium including only new coolant, by obtaining a concentration of the new coolant that should be included in the relevant cooling medium to obtain a cooling time the same as said cooling time.

* * * * *